United States Patent [19]

Sato et al.

[11] Patent Number: 4,952,980

[45] Date of Patent: Aug. 28, 1990

[54] LIQUID PROCESSING HEAD FOR AN ELECTROPHOTOGRAPHIC APPARATUS

[75] Inventors: Yosimitu Sato; Keiichi Yamana; Akira Yoda, all of Kanagawa, Japan

[73] Assignee: Fuji Photo Film Co., Ltd., Kanagawa, Japan

[21] Appl. No.: 194,369

[22] Filed: May 16, 1988

[30] Foreign Application Priority Data

May 20, 1987 [JP] Japan ..... 62-122864

[51] Int. Cl.[5] ..... G03G 15/10

[52] U.S. Cl. ..... 355/256; 354/317

[58] Field of Search ..... 355/256, 257; 354/317; 118/659, 660

[56] References Cited

U.S. PATENT DOCUMENTS

| | | | |
|---|---|---|---|
| 3,027,821 | 4/1962 | Wright | 354/317 X R |
| 3,196,832 | 7/1965 | Zin | 118/660 |
| 3,936,854 | 2/1976 | Smith | 355/256 X R |
| 4,591,543 | 5/1986 | Outsuka et al. | 118/660 X R |
| 4,600,291 | 7/1986 | Ohtsuka et al. | 355/256 |
| 4,622,915 | 11/1986 | Ohtsuka et al. | 355/256 X R |
| 4,623,240 | 11/1986 | Kimura et al. | 118/659 X R |
| 4,727,393 | 2/1988 | Ohtsuka et al. | 355/256 |

*Primary Examiner*—Fred L. Braun

*Attorney, Agent, or Firm*—Sughrue, Mion, Zinn, Macpeak & Seas

[57] ABSTRACT

A processing head for use in an electrophotographic apparatus which is designed to bring successive frames of an elongated photosensitive material to a developing section. In the developing section a developing agent is supplied to develop the images on the successive frames. A small amount of this developing agent leaks out of the developing section through minute gaps between the structure of the developing mask and the photosensitive material. To remove this developer leakage a guide groove area is provided to substantially surround the developing mask. This groove area has an exhaust opening which opens to the external environment surrounding the processing head. Pressurized air is supplied to this guide groove area to blow the leakage developer out of the groove and out through the portion which is open to the external environment.

14 Claims, 16 Drawing Sheets

LIQUID PROCESSING HEAD FOR AN ELECTROPHOTOGRAPHIC APPARATUS

BACKGROUND OF THE INVENTION

1. Field of the Invention

The present invention broadly relates to an electrophotographic apparatus and, more particularly, to a processing head for conducting various types of processing on electrophotographic films.

2. Description of the Related Art

Electrophotographic apparatus has been known in which an image is recorded in a predetermined frame of an electrophotographic film in such a manner that the recorded image can be projected or copied as desired.

U.S. Pat. Nos. 4,591,543, 4,600,291, 4,622,915, 4,623,240, 4,624,554 and so on disclose process heads which are adapted for effecting various treatments such as charging, exposure and developing processes on electrophotographic films.

The processing head disclosed in the above-mentioned publications has a charging/exposure section, a developing section, a drying section and a fixing section which are arranged in series in the mentioned border along the path of feed of the electrophotographic film, at a pitch or interval which corresponds to the pitch of frames on the electrophotographic film.

In the charging/exposure section, the portion of the electrophotographic film located in this section, constituting one frame, is charged and then exposed to an image light from an original, so that an electrostatic latent image corresponding to the pattern of an image carried by the original is formed in this portion of the film. The film is then fed so as to bring the exposed frame to the developing section where a liquid developer is applied to the electrophotographic film so as to develop the latent image thereby making it visible. Subsequently, the frame is brought to the drying section where drying air is blown to the electrophotographic film wetted by the liquid developer so as to remove the moisture component from the film. Finally, the frame is brought to the fixing section where the developed image is fixed to the electrophotographic film by means of, for example, a fixing lamp.

To the developing section, a developing agent is supplied while the electrophotographic film is held in close contact with the wall of the developing chamber. There is a risk that the developing agent is allowed to exude through the gap between the film and the wall of the developing chamber It is, therefore, preferred that a groove is formed around the developing chamber and the developing agent which has been made to flow out through the above-mentioned gap is made to flow into the groove and sucked by a suction means whereby surplus developing agent is removed from the developing section (see U.S. Pat. application Ser. No. 06/920.336 filed on Oct. 17, 1986now U.S. Pat. No. 4,727,392.)

The above-described known arrangement suffers from a disadvantage in that the suction port for sucking and removing the developing agent from the groove tends to experience the deposition of the developing agent with the result that the suction opening is narrowed and clogged with the deposited developing agent. It is therefore necessary to periodically remove the developing agent depositing and solidified in the suction port.

In view of the above-described problems of the prior art, an object of the present invention is to provide a process head for electrophotographic film, wherein the developing agent which has come out through gap between the developing chamber and the electrophotographic film can be smoothly removed without solidification.

To this end, according to the present invention, there is provided a processing head for use in an electrophotographic apparatus and designed to feed an elongated photosensitive material so as to bring successive frames on the photosensitive material to a developing section to which a developing agent is supplied, thereby to develop images on the successive frames, the processing head comprising; guide groove means having portions disposed upstream and downstream of the developing section as viewed in the direction of feed of the photosensitive material such as to extend in the breadthwise direction of the photosensitive material, the portions having one end opened to the outside at positions outside the adjacent breadthwise end of the photosensitive material; pressurized air supply port means disposed on the opposite side of the photosensitive material to the open ends of the portions of the guide groove means and communicated with the guide groove means at a position within the breadth of the photosensitive material; and pressurized air supply means for supplying the guide groove means with pressurized air through the pressurized air supply port means.

The above and other objects, features and advantages of the present invention will become clear from the following description of the preferred embodiments when the same is read in conjunction with the accompanying drawings.

DESCRIPTION OF THE PREFERRED EMBODIMENT

General Construction of the Electrophotographic Apparatus

Figure 1:
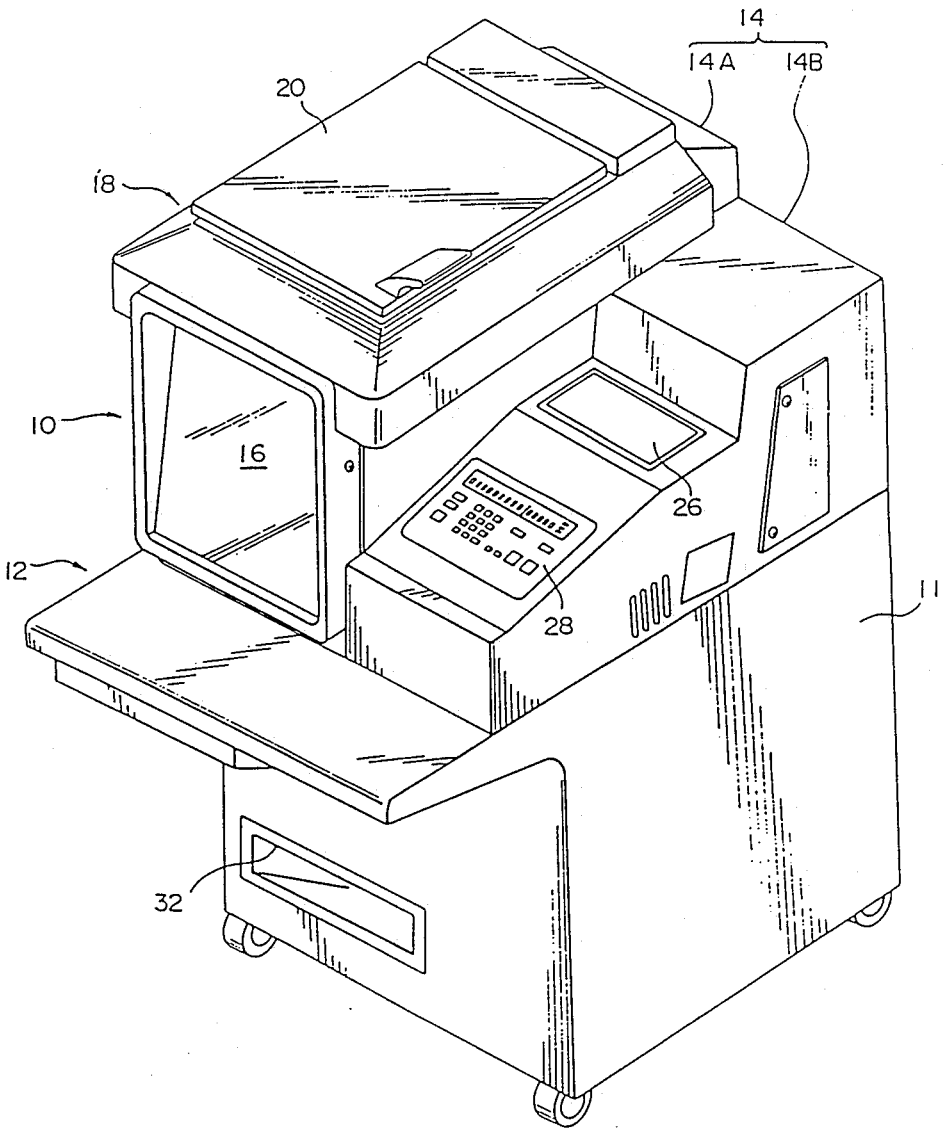
FIG. 1 is a perspective view of an electrophotographic apparatus to which the present invention pertains.

FIG. 1 shows one example of an electrophotographic apparatus having a processing head to which the present invention pertains. The electrophotographic apparatus has various functions: namely, a camera function which enables the image of a document to be recorded on an electrophotographic film; a reader function which enables the image recorded on the film to be enlarged and projected on a screen; and a copy function which enables the image recorded on the film to be enlarged and copied on a sheet of copying paper.

The electrophotographic apparatus has an integral structure which consists of an electrophotographic apparatus body 10, a housing 11, and a copying machine 12 serving also as a table for mounting the body 10. When the copy function is not needed, the electrophotographic apparatus body 10 may be used alone. The apparatus body 10 includes a housing 14 which consists of a left-hand portion 14A having a substantially rectangular parallelepiped configuration and a right-hand portion 14B which has a stepped upper surface. The respective internal spaces of these portions 14A and 14B are communicated with each other at the side thereof which is closer to the rear end of the apparatus.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate 20 in such a manner as to close an opening provided in the upper side of the housing portion 14A. A cassette loading section 26, into which a cassette accommodating an electrophotographic microfilm 24 (see FIG. 2; hereinafter referred to as an "electrophotographic film") is loaded, is provided in the central portion of the upper side of the housing portion 14B. A control keyboard 28 through which various controls of the electrophotographic apparatus are effected is disposed on the front portion of the upper side of the housing portion 14B.

Figure 4:
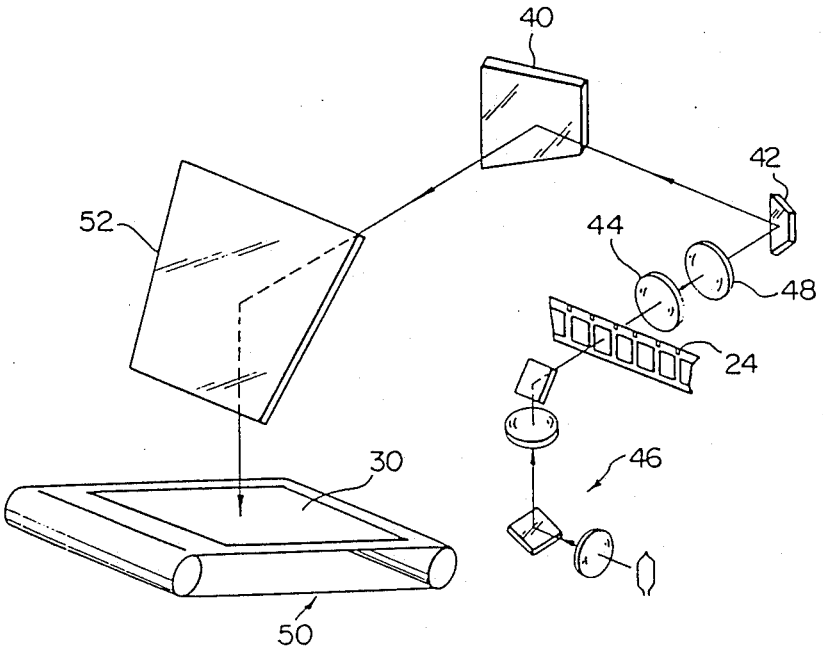
FIG. 4 is perspective view illustrating the concept of a copying optical system in the electrophotographic apparatus.

The housing 11 of the copying machine 12 is provided with an opening 32 for delivering a copied sheet of paper 30 (see FIG. 4).

Optical Systems of the Electrophotographic Apparatus

Figure 2:
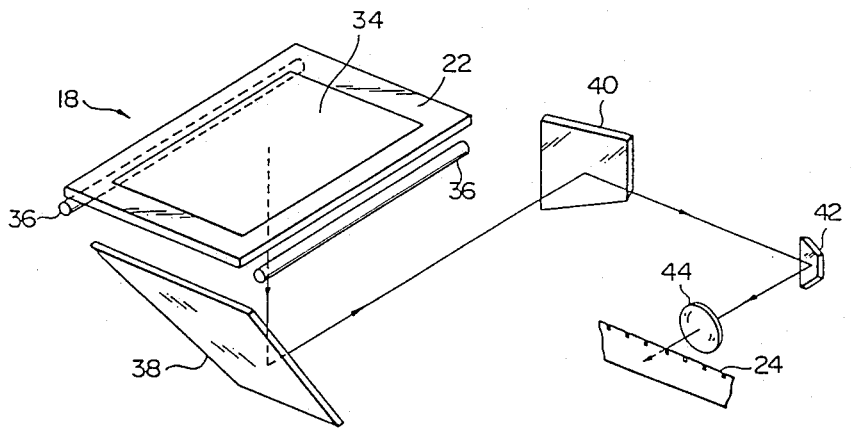
FIG. 2 is a schematic perspective view illustrating the concept of a photographing optical system in the electrophotographic apparatus.
Figure 3:
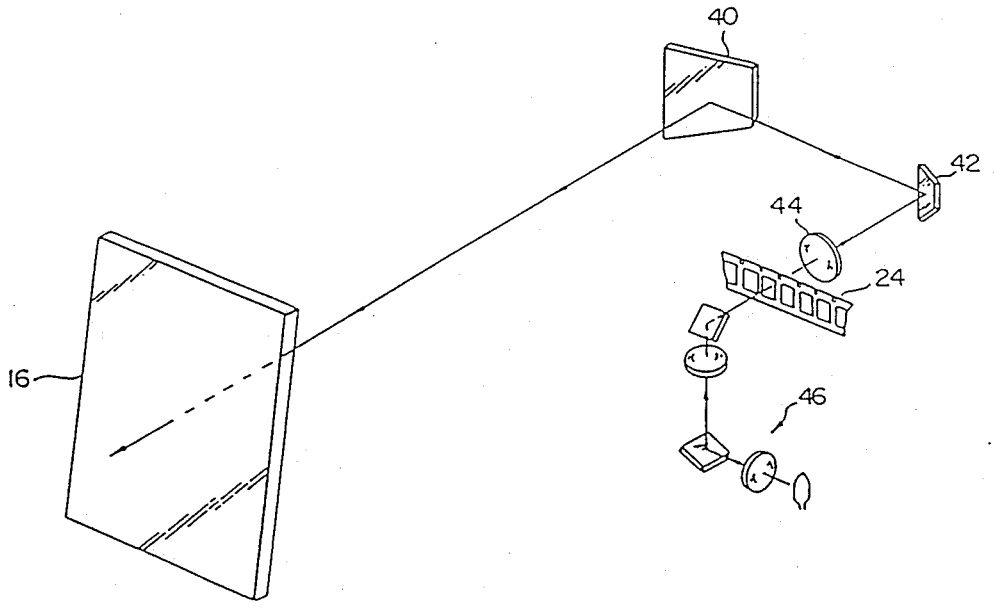
FIG. 3 is a perspective view illustrating the concept of a projecting optical system in the electrophotographic apparatus.

FIGS. 2 to 4 show various optical systems of the electrophotographic apparatus.

Referring first to FIG. 2, the recording optical system includes a document illumination lamp 36 which illuminates a document 34 as a subject which is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected form the second mirror 40 is made incident, and a main lens 44 for focusing the light reflected from the first mirror 42 on the surface of an electrophotographic film 24.

Referring next to FIG. 3, the projecting optical system includes a projecting light source section 46 for irradiating the electrophotographic film 24, the main lens 44 for focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes the projecting light source section 46, the main lens 44, the first mirror 42, the second mirror 40, a conversion lens 48 disposed between the main lens 44 and the first mirror 42 to slightly reduce the optical image formed on the first mirror 42, and a copy mirror 52 adapted to reflect the light reflected from the second mirror 40 toward a sheet of copying paper 30 set on an exposing table 50 disposed in the copying machine 12.

The main lens 44 and the first and second mirrors 42, 40 are mutually used for the above-described three optical system. The main lens 44 and the first mirror 42 are fixedly disposed within the housing portion 14B of the electrophotographic apparatus body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the apparatus body 10, while the conversion lens 48 is movably disposed within the housing portion 14B so that the lens 48 is prevented from interfering with any other optical system. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic apparatus.

Processing Head

FIGS. 5 to 13 show in combination one embodiment of the processing head according to the present invention which is disposed in the above-described electrophotographic apparatus.

Figure 5:
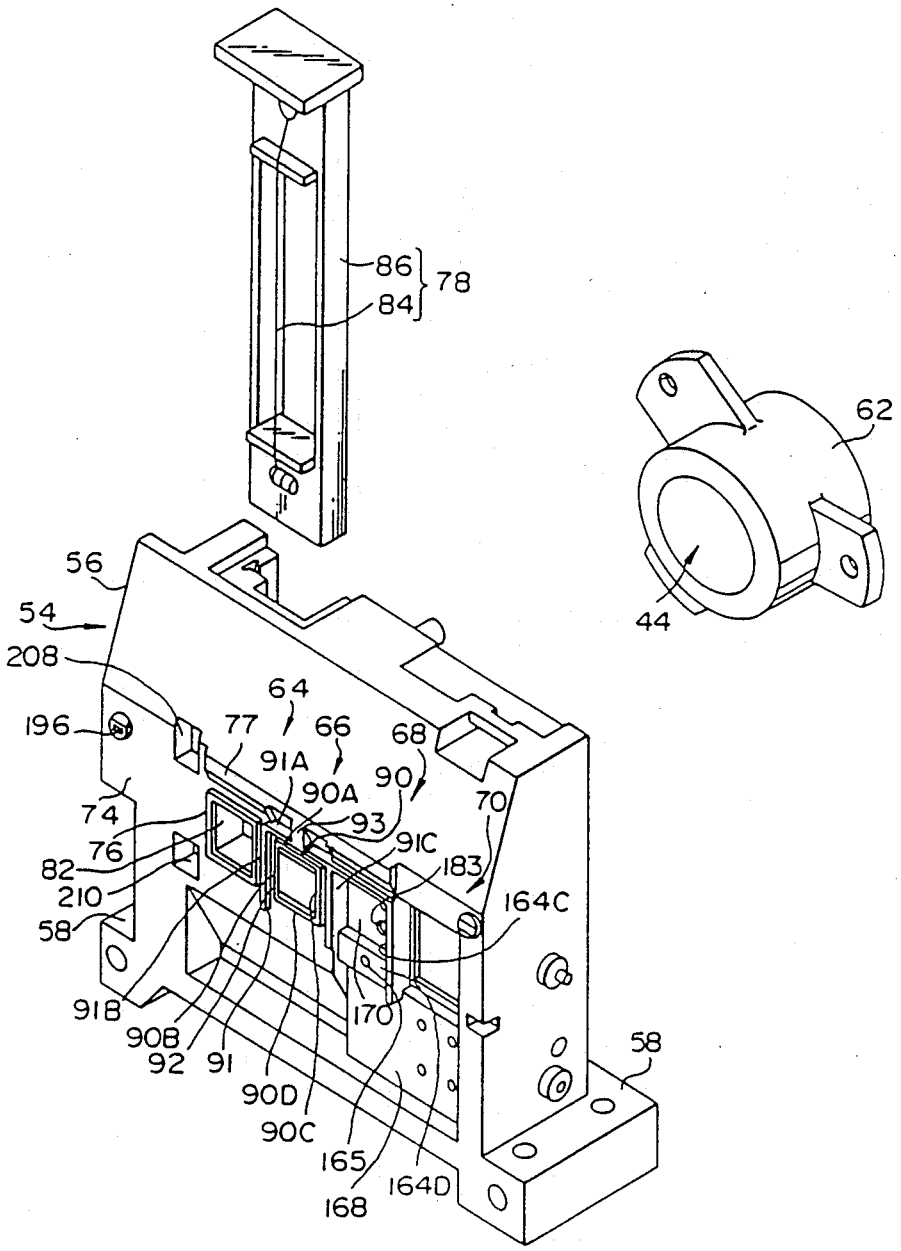
FIG. 5 is an exploded perspective view of a processing head embodying the present invention and incorporated in the electrophotographic apparatus shown in FIG. 1.
Figure 6:
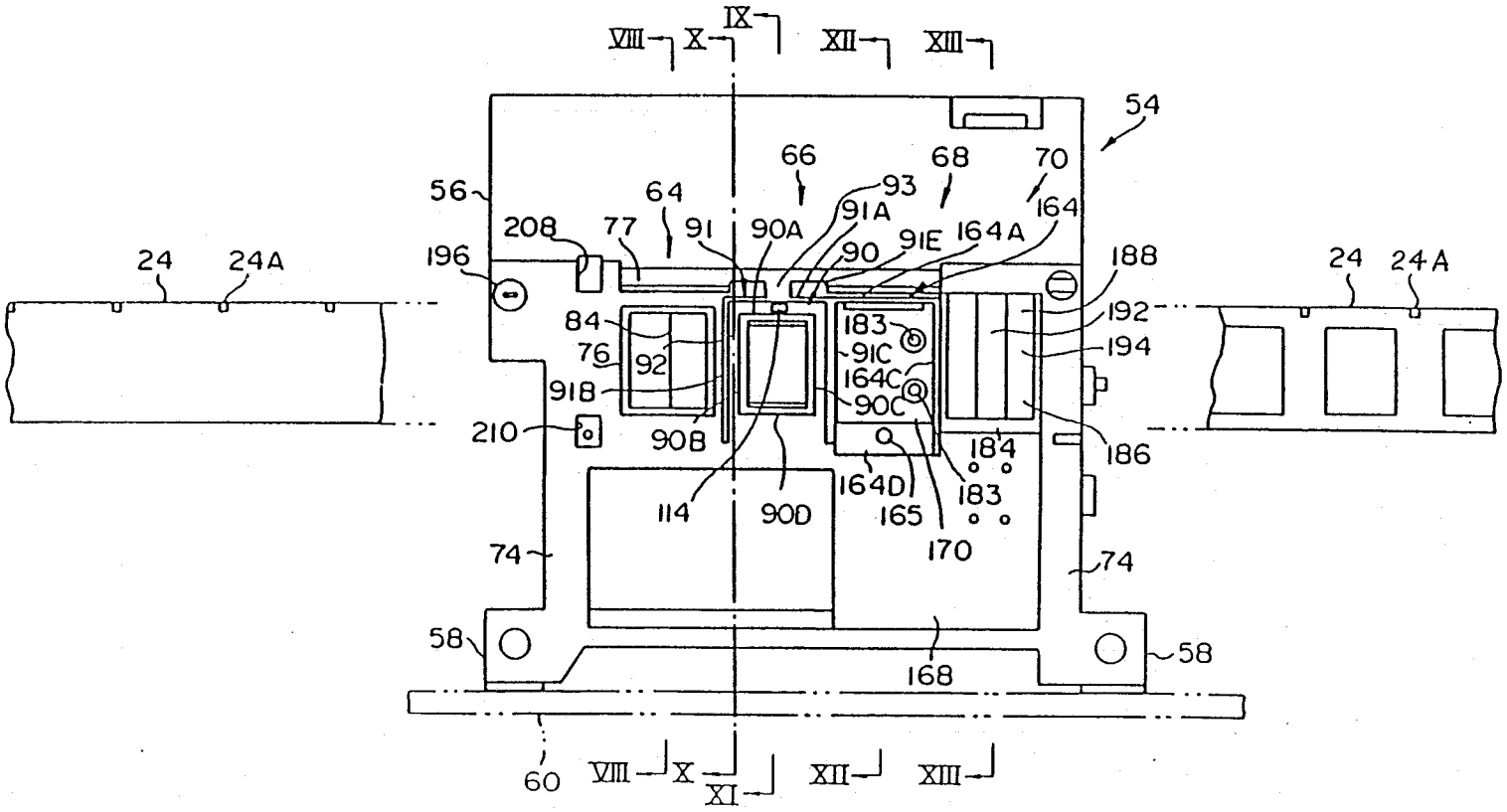
FIG. 6 is a front elevational view of the processing head shown in FIG. 5.

Referring first to FIG. 5 and 6, the processing head 54 has an integral structure which consists of a relatively flat body portion 56 having a substantially rectangular parallelepiped configuration, and a pair of leg portions 58 located below the body portion 56. The processing head 54 is formed from a synthetic resin by an integral molding process except for fitting members. The processing head 54 is disposed between the main lens 44 and the electrophotographic film 24, which are shown in FIGS. 2 to 4, and the leg portions 58 are secured to a frame 60 disposed within the housing portion 14B of the apparatus body 10, as shown in FIG. 6.

Figure 7:
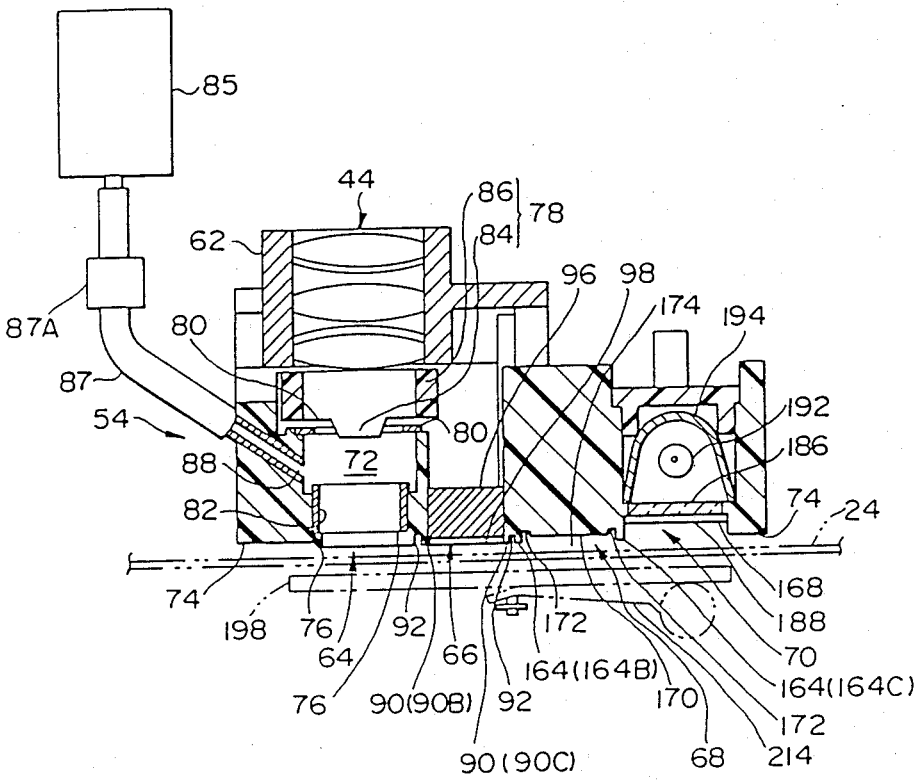
FIG. 7 is a sectional view taken along the line VII—VII in FIG. 6.

The main lens 44 is, as shown in FIGS. 5 and 7, fitted in a lens tube 62 which, in turn, is secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A are printed in advance on the upper edge (as viewed in FIG. 6) of the film 24 at a predetermined regular spacing in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (the horizontal direction as viewed in FIG. 6) of the processing head 54 by driving a film moving motor (not shown) The transparent electrically conductive layer of the film 24 is adapted to provide electrical connection with the when the cassette is loaded therein. It is a matter of course that any type of known electrophotographic film may be employed in addition to the film of the type described above.

As shown in FIGS. 5 to 7, a charging/exposure section 64, a developing section 66, a drying section 68 and a fixing section 70 are successively formed in the body portion 56 of the processing head 54 along the lateral direction thereof at a constant pitch which corresponds to the frame pitch of the film 24.

Charging/Exposure Section

Figure 8:
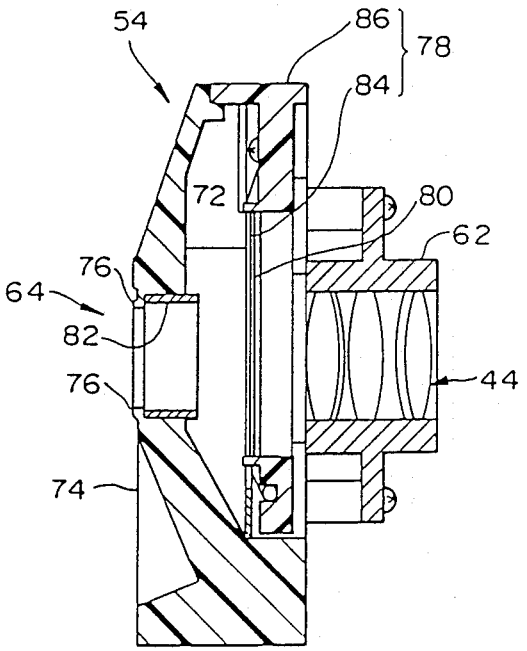
FIG. 8 is a sectional view taken along the line VIII—VIII in FIG. 6.

As shown in FIGS. 7 and 8, the charging exposure section 64 has a charging exposure chamber 72 which is defined by an internal space provided on the reverse side of a front wall 74 of the processing head 54. The chamber 72 is communicated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to one frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and disposed in the vicinity of the opening in the front wall 74. The corona wire 84 is connected to a high-voltage power supply, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 85 through a conduit 87 and an orifice 87A. The main lens 44, which is mounted on the rear side of the processing head 54 through the lens tube 62, has the optical axis thereof made coincident with the center of the opening defined by the mask 76.

The charging/exposure section 64 has a transversely-extending guide projection 77. The guide projection 77 (FIG. 5) has the same height as the mask 76 and is intended for preventing, when the electrophotographic film 24 is set in the cassette loading section 26 together with the cassette, the electrophotographic film 24 from being caught by the mask 76 on the front wall 74 of the main part 56 of the processing head 56. To this end, the surfaces on the upper and lower sides are tapered such as to progressively decrease the height.

Developing Section

Figure 9:
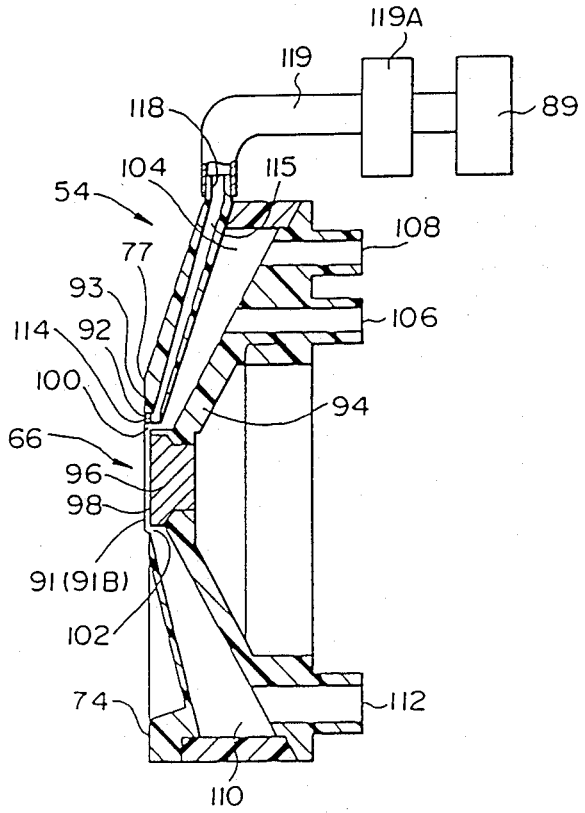
FIG. 9 is a sectional view taken along the line IX—IX in FIG. 6.
Figure 10:
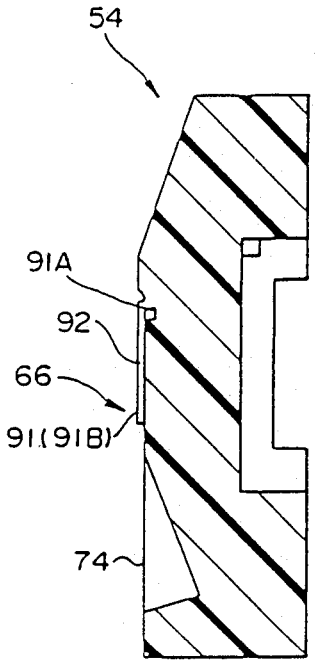
FIG. 10 is a sectional view taken along the line X—X of FIG. 6.

As shown in FIGS. 5 and 6, the developing section 66 has a mask 90. The mask 90 is defined by an upper frame member 90A, left and right frame members 90B, 90C, and a lower frame member 90D which protrude from the front wall 74. The developing section is thus defined. The upper frame member 90A and the left and right frame members 90B and 90C and the lower frame member 90D are connected together. The height or amount of protrusion of the mask 90 is the same as that of the protrusion of the mask 76 in the charging/exposure section. An outer frame 91 also protrudes from the front wall 74 so as to surround the mask 90, thus forming a guide recess or groove 92 between itself and the mask 90. The recess or guide groove 92 has a U-shaped cross-section as shown in FIG. 9. The height or amount of protrusion of the outer frame 91 is the same as that of the mask 90. The recess or guide groove 92 surrounds the mask 90 and opens at its lower side to the air space surrounding the processing head 54. As is the case of the mask 90, the outer frame 91 has an upper outer frame member 91A, left and right outer frame members 91B, 91C. The left and right outer frame members 91B and 91C are disposed on the upstream and downstream ends as viewed in the direction of convey of the electrophotographic film 24. The central portion of the upper frame member 91A is connected through a narrow guide projection 93 to a horizontal guide projection 77 which extends horizontally from an upper portion of the charging/exposure section 64. As shown in FIGS. 6 and 7, the recess or guide groove 92 is defined as a U-shape. The width of the recess or guide groove 92 is greater at the portion between the upper frame members 90A and 91A than at the portion between the left frame members 90B and 91B and the portion between the right frame members 90C and 91C.

The guide projection 93 plays the same role as the guide projection 77 of the charging/exposure section 64. The portion between the guide projection 77 on the upper portion of the developing section 66 and the upper outer frame member 91A of the outer frame 91 has the form of a groove the depth of which is progressively increased towards the upper frame member 91A.

The width of the opening defined by the mask 90 is set such as to be slightly smaller than that of the opening defined by the mask 76. The height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

As shown in FIG. 9, a developing electrode 96 is disposed within the opening defined by the mask 90, the electrode 96 being supported by a rear wall 94. The developing electrode 96 is connected to a bias power supply. The developing electrode 96 is positioned in such a manner that the outer surface thereof is located at a position which is slightly inner than the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and the mask 90 to define a developer and squeezing air outlet 102.

The surface of the mask 90 of the developing chamber is smoothed so as to exhibit a high draining efficiency.

The developer and squeezing air inlet 100 is communicated with a passage 104 constituted by the internal space of the process head 54. The passage 104 is communicated with a developer supply port 106 and a squeezing air supply port 108, which are provided in the rear side of the processing head 54. The developer and squeezing air outlet 102 is communicated with a passage 110 defined by a space inside the processing head 54. The passage 110 is communicated with a developer and squeezing air discharge port 112 which is provided in the rear side of the processing head 54.

As will be seen from FIGS. 6 and 9, sealing air pressure supply ports 114 are provided in the portions of the bottom wall of the recess or guide groove 92 located between the upper frame member 0A and the upper frame member 91A.

The pressurized air or purging air supply ports 114 are communicated with a passage 115 which is constituted by an internal space of a process head 54. The passage 115 in turn communicates with a seal pressure inlet 118 formed in the upper side of the process head 54. The seal pressure supply port 118 is adapted to be supplied with pressurized air from an air pump 89 through an orifice 119A which constitutes an example of the air flow-rate control means. The air flow-rate control means may be constituted by other means such as solenoid valves capable of controlling the air flow rates.

Figure 11:
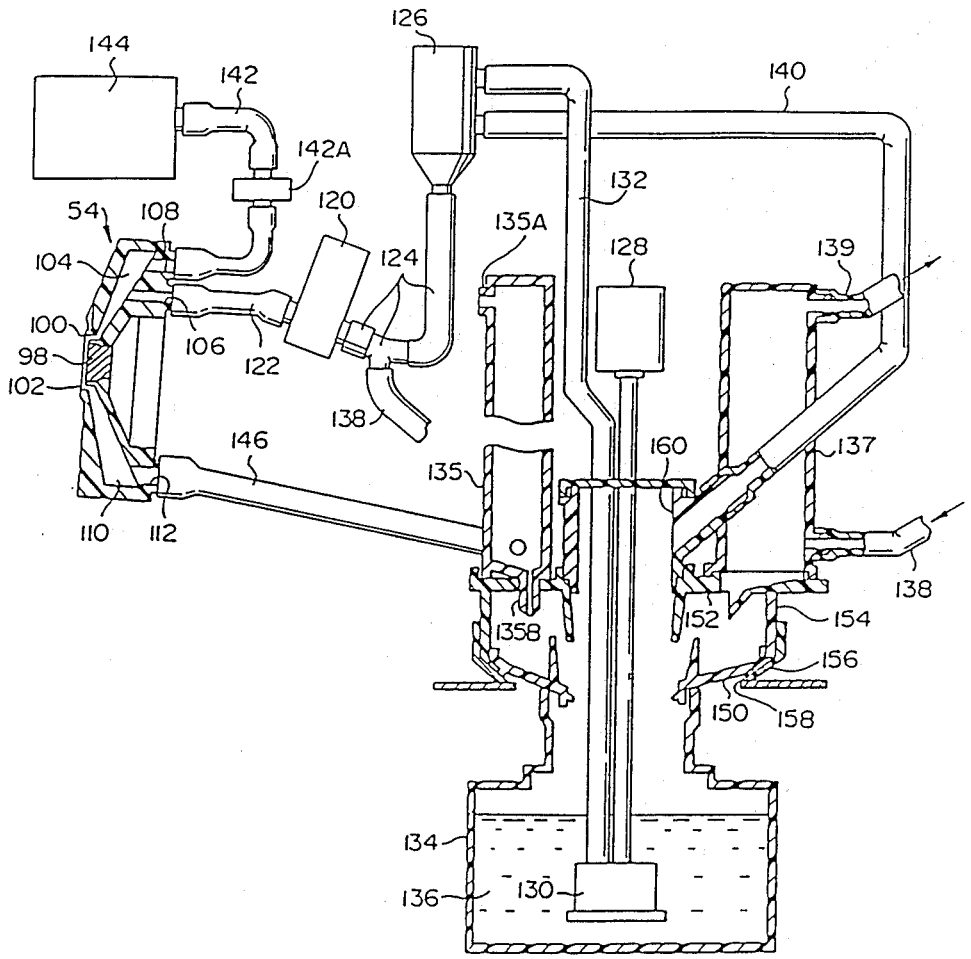
FIG. 11 is an illustration of a developing section in the processing head in relation to other devices.

Referring now to FIG. 11, the developer supply port 106 is connected to a developer tank 126 through conduits 122 and 124 past the solenoid valve 120. The developer tank 126 is set at a level above the level of the solenoid valve 120. A developer pump 130 driven by a motor 128 is connected to the developer tank 126 through a conduit 132. The developer pump 130 is disposed in a developer bottle 134 which contains a developer 136 composed of toner particles dispersed in a solvent.

The conduit 124 between the solenoid valve 120 and the developer 126 has a branch which constitutes a return conduit 138 opening in the developer bottle 134 via a trap 137. A suction pump (not shown) is connected to the trap 137 through a conduit 139 so as to induce only air from the trap 137. A return conduit 140 which opens in the developer bottle 134 is connected to the developer tank 126.

The squeezing air supply port 108 is connected to a pressurizing squeezing air pump 144 through a conduit 142 so that it supplies squeezing air pumped by the air pump 144.

A return conduit 146, which is connected to the aforementioned developer and squeezing air outlet 112, opens in a gas-liquid separator 135 attached to the developer bottle 134. A frusto-conical saucer 150 is mounted on the developer bottle 134. The lower end of the saucer 150 slightly projects inwardly of the developer bottle 134 and the underside of the saucer 150 hermetically contacts the upper end of the developer bottle 134 so as to close the developer bottle 134. The arrangement is such that, when the motor 128 is lifted, the developer pump 130 also is raised so that a lower flange on the pump 130 engages with the brim of the saucer 150, whereby the saucer 150 is withdrawn together with the pump 130, thereby allowing the developer bottle 134 to be replaced.

During the upward movement, the saucer 150 slides along the inner peripheral surface of a cylindrical member 154 which is suspended vertically from a supporting plate 152. The saucer member 150 has a downward annular projection 158 which resiliently engages with a tapered resilient sheet 156 attached to the cylindrical member 154 thereby sealing the interior of the developer bottle 134 from the ambient air.

Another cylindrical member 160 is fixed to the supporting plate 152. The return conduit 140 is communicated with the interior of this cylindrical member 160. The aforementioned gas-liquid separator 135, which is located adjacent to the cylindrical member 160 is provided with a communication port 135A formed in a portion of the side wall near the top end thereof and communicating with the ambient air. A discharge conduit 135B projects downward from the bottom of the gas-liquid separator 135 through a hole formed in the supporting plate 152 so as to return only the liquid content into the developing bottle 134.

In FIG. 11, the process head 54 is illustrated at a slight inclination. This is because the process head 54 is inclined in such a manner as to set the optical axis of the optical system perpendicularly to the screen 16 which is installed at an inclination.

Drying Section

As shown in FIGS. 5 and 6, the drying section 68 has a frame wall 164. The frame wall 164 is composed of an upper frame member 164A which is a horizontal extension of the upper frame member 91A of the developing section 66 and a right frame member 164C which depends from the end of the upper frame member 164A so as to oppose the right frame member 90D of the developing section 66. The upper frame member 164A and the right frame member 164C have the same height as the outer frame 91 and the mask 90 in the developing section 66. The frame wall 164 further has a lower frame member 164D disposed between the right frame member 164C of the drying section 68 and the right frame member 90C of the developing section 66 and having a projection height smaller than that of these frame members. A hole 165 for mounting a heater is formed in this lower frame member 164D.

A drying region 174 in the drying section 68 is defined by the upper frame member 164A, right frame member 164C and the lower frame member 164D of the drying section 68 and also by the right frame member 91C of the developing section 66. The bottom surface 170 of the drying region 174 thus defined is of the same projection height as the front wall 168 which is recessed from the front wall 74 under the drying section 68 and the fixing section 70.

The size of the region inside the frame wall 164 is greater than that of the developing mask 90. A guide projection 77, which is extended through a region above the developing section 66, is positioned above the upper frame member 164A. This guide projection 77 has the same role as the guide projection 77 of the charging/exposure section 64 and the guide projection 93 of the developing section 66. The span of the region inside the frame wall 164, i.e., the distance between the right frame member 164C of the drying section 68 and the right frame member 91C of the developing section 66, is greater than the width of opening of the mask 90. The lower surface of the upper frame member 164A, i.e., the surface facing the drying region, is positioned at a level above that of the mask 90 of the developing section 66.

Figure 12:
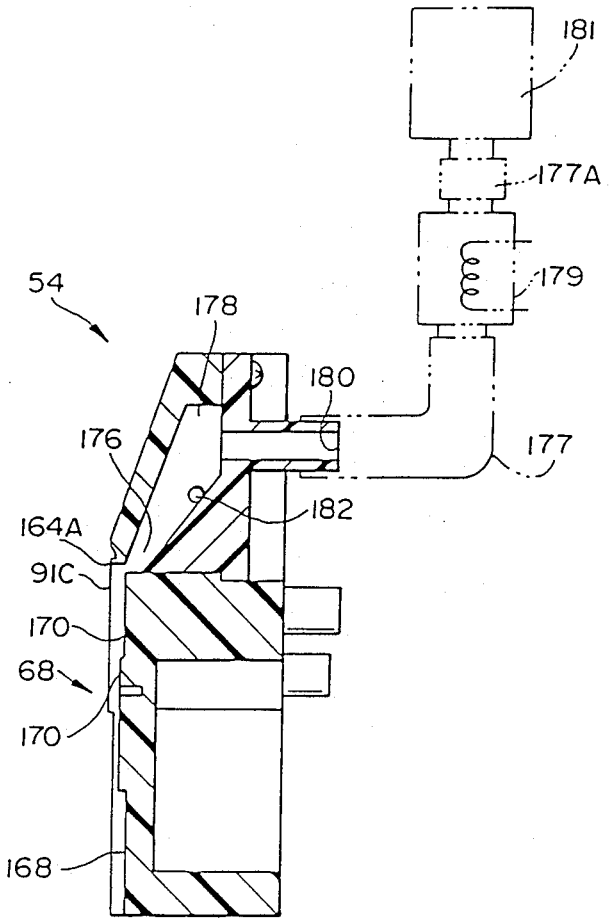
FIG. 12 is a sectional view taken along the line XII—XII of FIG. 6.

As will be seen from FIGS. 6 and 12, the lower portion of the upper frame member 164A is slit so as to constitute a heated air outlet 176. The heated air outlet 176, as will be seen from FIG. 12, communicates with a passage 178 which is constituted by the space inside the process head 54. The passage 178 communicates with a heated air supply port 180 which opens in the rear wall of the process head 54. A temperature sensor 182 is disposed in the passage 178. An air pump 181 is connected to the heated air supply port 180 through a conduit 177 having a heater 179 and an orifice 177A so that heated air is supplied into the passage 178.

The bottom wall 170 of the drying section has a pair of circular holes 183 which serves as leader holes for electric wiring to the heater which may be attached to the bottom wall 170.

Fixing Section

The fixing section 70 is, as shown in FIGS. 5 to 7, defined between the right frame member 164C of the frame 164 and the right-hand end portion of the front wall 74. The fixing section 70 has a frame 184 which consists of a lower frame member and left and right frame members, the frame 184 being located at a position which is further depressed from the recess 168 in the front wall 74. A transparent glass plate 186 is fitted in the frame 184. The space provided on the front side of the glass plate 186 defines a fixing chamber 188.

Figure 13:
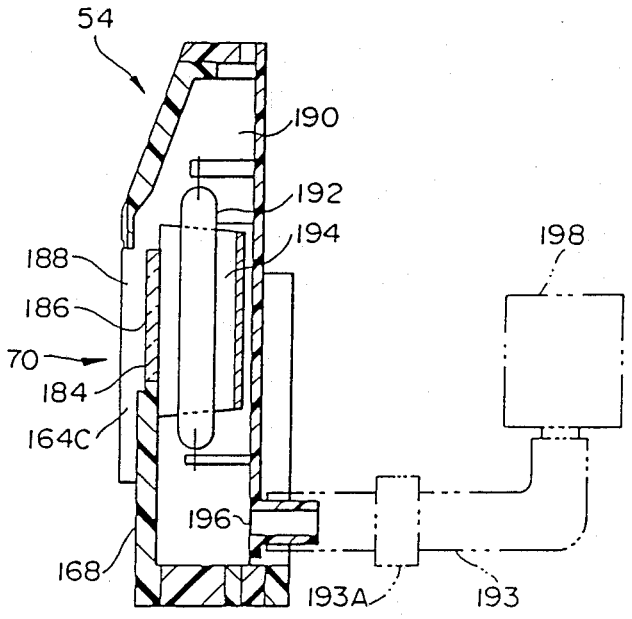
FIG. 13 is a sectional view taken along the line XIII—XIII of FIG. 6.

As shown in FIG. 13, a xenon lamp 192 and a reflecting plate 194 are disposed within a space 190 inside the processing head 54 which is provided on the reverse side of the glass plate 186. A cooling air inlet 196 opens into the space 190 so that cold air is supplied to the space 190 from an air pump 195 through a conduit 193 and an orifice 193A. The space 190 and the fixing chamber 188 are communicated with each other through the area defined at the upper edge of the glass plate 186.

Blip Sensor

Referring to FIGS. 5 and 6, the processing head 54 has a blip sensor 196 which is disposed on the left-hand end portion of the front wall 74. The blip sensor 196 is located at a position at which the blip marks 24A printed on the electrophotographic film 24 pass, the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

Film Pressing Mechanism

Figure 14:
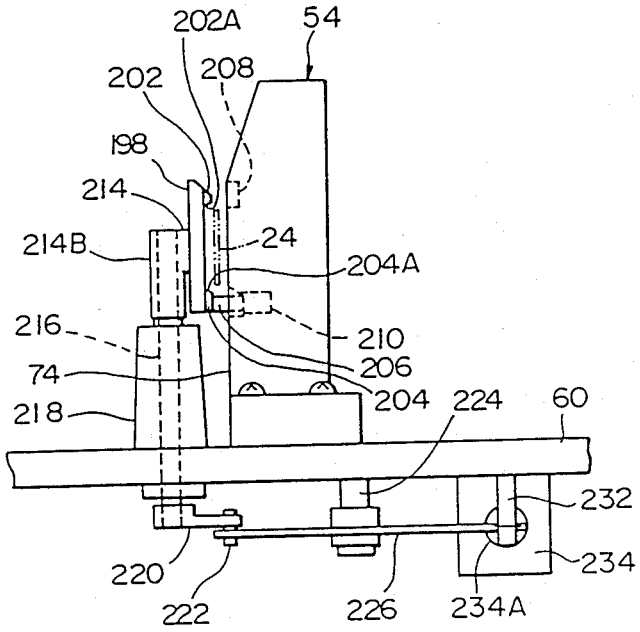
FIG. 14 is a schematic side elevational view of an essential portion of the present invention, illustrating the positional relationship between the processing head and a pressing plate.

As shown in FIGS. 7 and 14, a pressing plate 198 serving as the film pressing means is disposed in front of the front wall 74 of the processing head 54. The pressing plate 198 is, as shown in FIG. 15, provided with a rectangular through-hole 200 which is a size smaller than the opening defined by the mask 76 formed in the charging exposure section 64. The pressing plate 198 is disposed in such a manner that the through-hole 200 opposes the mask 76.

Figure 15A:
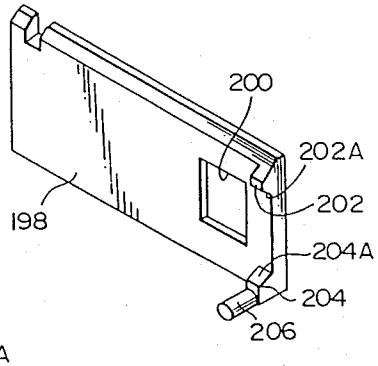
FIG. 15A is a perspective view of a portion of the film pressing mechanism as seen from the opposite side to FIG. 15.
Figure 15:
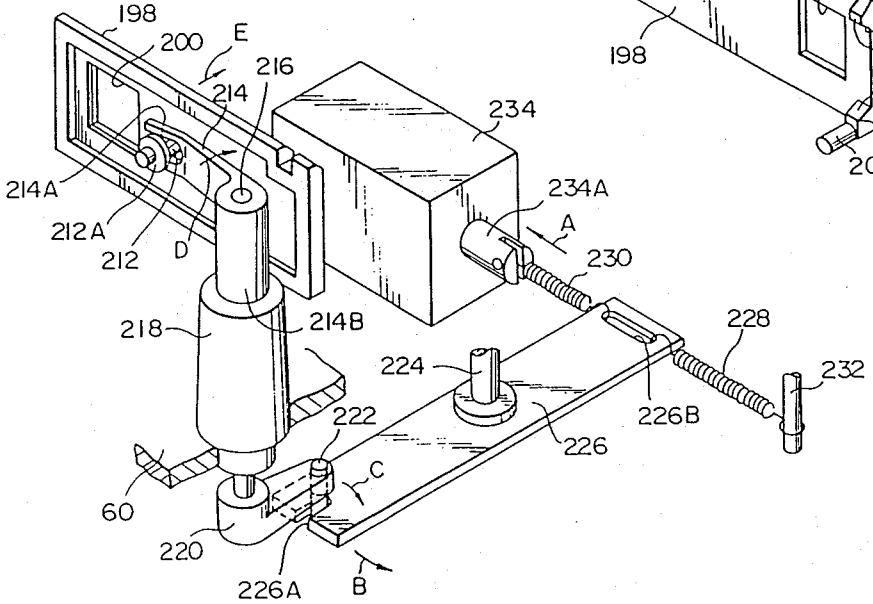
FIG. 15 is a perspective view of a film pressing mechanism provided on the processing head.

As will be seen from FIG. 15A which is a perspective view as viewed in the direction opposite to FIG. 15, the pressing plate 198 has claws 202, 204 which are formed at an upper portion and a lower portion thereof near the end having the through-hole 200, such as to project towards the process head 54. The opposing surfaces of these claws 202 and 204 are slanted as at 202A and 204A. As will be understood from FIG. 14, the distance between upper and lower claws 202, 204 as measured at base portions of these claws is substantially the same as, more precisely slightly greater than, the width of the electrophotographic film 24. A columnar portion 206 is formed on the claw 204 so as to project therefrom. These claws 202 and 204 are adapted to be received in holes 208 and 210 which are formed in the front wall 74 of the process head 54.

The pressing plate 198 has a columnar portion 212 projecting from the reverse surface thereof, that is, the surface thereof which is remote from the processing head 54. This columnar portion 212 is engaged with a notched portion 214A formed at one end portion of an arm 214. A stop ring 212A is rigidly secured to the distal end portion of the columnar portion 212 so as to prevent the notched portion 214A from coming off the columnar portion 212. A boss portion 214B is formed at the other end of the arm 214. A shaft 216 is rigidly secured to the boss portion 214B.

The shaft 216 is rotatably fitted into and thereby supported by a stand 218 projecting from the frame 60 to which the processing head 54 is secured, the lower end portion of the shaft 216 projecting from the reverse surface of the frame 60. A first lever 220 is rigidly secured to the projecting lower end portion of the shaft 216. A pin 222 is rigidly secured to the distal end portion of the first lever 220.

A shaft 224 is suspended from the reverse side of the frame 60. The shaft 224 pivotally supports the intermediate portion of a second lever 226. A notched portion 226A is formed at one end of the second lever 226, and the pin 222 is engaged with the notched portion 226A. A slot 226B is formed in the other end portion of the second lever 226, and one end portion of each of the tension coil springs 228 and 230 is retained by the slot 226B, the springs 228 and 230 biasing the second lever 226 in the opposite directions to each other so as to support the lever 226 resiliently.

The other end portion of the tension coil spring 228 is retained by a pin 232 suspended from the reverse side of the frame 60, while the other end portion of the tension coil spring 230 is retained by a plunger 234A of a pull-type solenoid 234 which is secured to the reverse side of the frame 60.

When the solenoid 234 is not energized, the pressing plate 198 is separated from the processing head 54. In this state, the pressing plate 198 is supported in such a manner that the columnar portion 206 is fitted into the bore 210 as shown in FIG. 14.

When the solenoid 234 is energized, the plunger 234A is activated to move in the direction of the arrow A, causing the tension coil springs 228 and 230 to be expanded against the biasing forces. In consequence, the second lever 226 is pivoted about the shaft 224 in the direction of the arrow B, so that the first lever 220 is pivoted about the pin 222 in the direction of the arrow C, thus causing the shaft 216 to turn in the same direction. Thus, the arm 214 is pivoted in the direction of the arrow D so to press the pressing plate 198 in the direction of the arrow E.

Therefore, the pressing plate 198 is made to move in the direction of the arrow E with the columnar portion 206 guided by the hole 210, thereby urging the electrophotographic film into contact with the masks 76, 90 and the end surface of the frame wall 164. Any heightwise misalignment of the electrophotographic film 24 is corrected during this movement of the pressing plate 198 because the slanted surfaces 202A and 204A of the claws 202 and 204 serve as guides which are capable of urging the upper edge and the lower edge of the film 24 downward and upward, respectively.

The pressing plate 198, when keeping the electrophotographic film in contact with the process head 54, is correctly located with respect to the process head 54 because the claws 202 and 204 are received in the holes 208 and 210. In this state, the pressing plate 198 is resiliently urged by the coiled springs 228, 230 so as to press the electrophotographic film in a resilient manner.

As the solenoid 234 is de-energized, the second lever 226 is pivoted in the direction counter to the direction of the arrow B by the force of the tensile spring 228, so that the arm 214 is rotated in the direction counter to the direction of the arrow D. In consequence, the notched portion 214A presses the stop ring 212A, causing the pressing plate 198 to move counter to the direction of the arrow E.

Operation

The following is a description of the operation of this embodiment.

The electrophotographic apparatus is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26 is locked at said position. In this state, the film 24 is positioned as shown in FIG. 14 and is allowed to move along the front side of the processing head 54 by the operation of a film moving motor (not shown).

When the image of the document 34 (shown in FIG. 2) is to be recorded on the film 24, the film moving motor is activated to move the film 24 in such a manner that a given frame which is selected from the unexposed frames as desired is positioned in from of the mask 76 in the charging exposure section 64. This operation is executed by designating a desired frame through the control keyboard 28 shown in FIG. 1. The positioning of the selected frame with respect to the charging exposure section 64 is effected by virtue of the blip sensor 196 which counts the number of blip marks 24A from a reference point.

Figure 16:
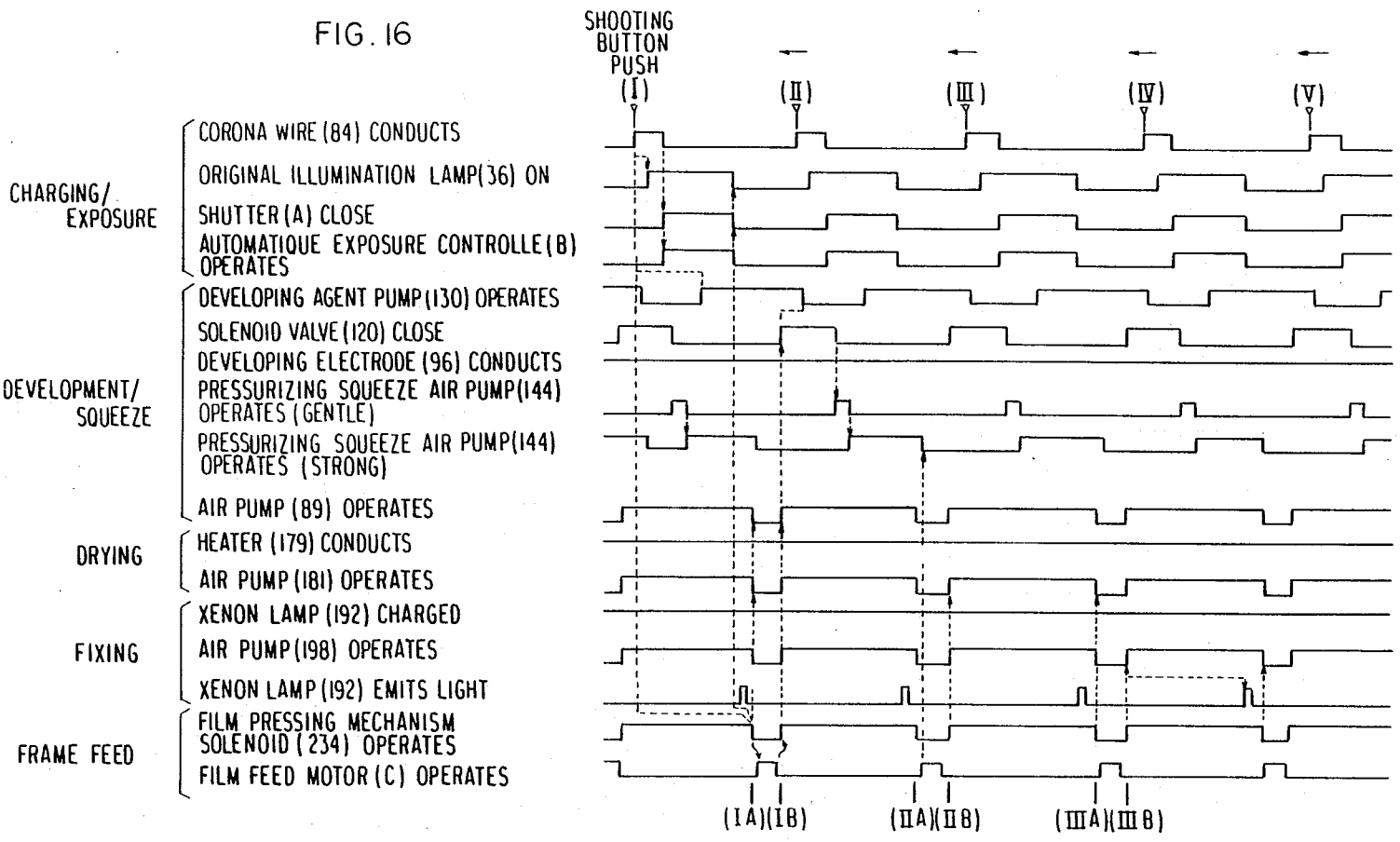
FIG. 16 is a time chart showing the operation of the electrophotographic apparatus in camera mode.

FIG. 16 is a time chart showing the operation of the apparatus in the case where a given frame is positioned as described above and subjected to recording and, subsequently, continuous recording is effected on each of the frames which consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will be made about only one frame which is to be subjected to recording when the recording button is pressed at the position (I) in FIG. 16 to start recording.

Recording of the document 34 is made possible by selecting the camera mode through the control keyboard 28. Simultaneously with this mode selecting operation, a bias voltage is applied to the developing electrode 96 in the developing section 66, the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 24 which is positioned within the opening defined by the mask 76 is charged positive.

At the time when the recording button is pressed, the solenoid 234 in the film pressing mechanism has continuously been excited from the previous step. Therefore, the film 24 is pressed by the pressing plate 198 so as to be in pressure contact with the respective end faces of the masks 76, 90 and the frame 164 of the processing head 54. The pressing plate 198 has the through hole 200 formed in a portion thereof which opposes the mask 76, but this through-hole 200 is smaller than the opening defined by the mask 76. Therefore, a portion of the film 24 which is positioned at the end face of the mask 76 is pressed by the surface of a portion of the pressing plate 198 around the through-hole 200. Accordingly, the film 24 is reliably brought into close contact with the end face of the mask 76, and the charging range is thereby accurately limited within the opening in the mask 76.

Since the mask electrode 82 provided in the charging-/exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamp 36 is turned ON when a predetermined period of time has elapsed after the recording button has been pressed at the position (I) in FIG. 16, so as to illuminate the document 34 placed on the glass plate 22 of the document table 18. Further, when a predetermined period of time has elapsed after the recording button has been pressed, the supply of current to the corona wire 84 is suspended, thus completing the corona discharge operation.

At the same time as the suspension of the energization of the corona wire 84, a shutter (not shown but indicated by the reference symbol A in FIG. 16) is opened, and the light reflected from the document 34 placed on the document table 18 is applied to the film 24 by the optical system shown in FIG. 2. In addition, the automatic exposure controller (not shown but indicated by the reference symbol B in FIG. 16) simultaneously starts integration of the quantity of light.

On the other hand, when a predetermined period of time has elapsed after the recording button has been pressed, the motor 128 shown in FIG. 11 is activated to start the operation of the developer pump 130, whereby the developer 136 in the developer bottle 134 is pumped up into the developer tank 126. The developer 136 thus pumped falls from the developer tank 126 by the force of gravity towards the processing head 54 through the conduit 124. In this state, however, the solenoid valve 120 is still kept closed so that the developer 136 is returned to the developer bottle 134 via the return conduit 138. When the level of the developer 136 in the developer tank 126 is raised to a predetermined limit, the developer 136 is returned to the developer bottle 134 through the return conduit 140.

Thus, the developer 136 is circulated between the developer bottle 134 and the developer tank 126 and is stopped at the upstream side of the solenoid valve 120 until the solenoid valve 120 is opened. This recirculation produces an appreciable stirring effect on the developer 36 in the developer bottle 134.

When the integrated value of the quantity of light reaches a set value, the integration effected by the automatic exposure controller (B) is suspended and, at the same time, the shutter (A) is closed, and the document illuminating lamp 36 is turned OFF. At this point of time, the exposure step is completed and, one frame of the film 24 in a portion thereof which is positioned at the opening defined by the mask 76 has an electrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamp 36, are corrected by the automatic exposure controller (B), an optimal exposure operation is effected at all times. When a predetermined period of time has elapsed after the recording button had been pressed and all the steps of processing other frames have already been completed, the solenoid 234 of the film pressing mechanism is immediately de-energized. When the solenoid 234 is de-energized at the position (IA) in FIG. 16, the pressing plate 198 is separated from the film 24.

When a predetermined period of time has elapsed after de-energization of the solenoid 234 of the film pressing mechanism, the film moving motor (not shown but indicated at C in FIG. 16) is started so as to effect a one-frame feed of the photographic film 24 rightward as viewed in FIG. 6. In consequence, the frame which has been positioned in the charging/exposure section 64 is moved to the developing section 66. The feed of the electrophotographic film 24 is controlled in accordance with the signal from the blip sensor 196 capable of sensing the blip mark 24A so that the amount of feed precisely coincides with the pitch of the frame, as explained before.

When a predetermined time has elapsed after the stop of the film moving motor C, the solenoid 234 of the film pressing mechanism is energized at a moment (IB) in FIG. 16, thereby causing the pressing plate 198 to press the electrophotographic film 24 onto the processing head 54. At the same time, suction through the suction squeeze opening 118 is commenced and the solenoid valve 120 is opened.

When the solenoid valve 120 is opened, the developer 136 is allowed to reach the processing head 54 through the conduit 122, and the developer 136 then flows into the developing chamber 98 from the developer and squeezing air inlet 100 in the developing section 66. Since the toner particles dispersed in the developer 136 are charged negative, the toner particles, when flowing down through the developing chamber 98, adhere to portions of the film 24 which are charged positive, thereby developing the electrostatic latent image. The developer 136 having flowed down through the developing chamber 98 is returned to the developer bottle 134 from the developer and squeezing air outlet 102 through the return conduit 146.

The diameters of the conduits and other parameters of the developer supply system are so determined tha the developer supplied from the developer tank 126 to the conduit 124 is partially returned to the developer bottle 134 through the return conduit 138, while the remainder part of the developer is directed to the solenoid valve 120.

Although the electrophotographic film 24 is pressed by the pressing plate 198 onto the end surface of the mask 90, a small amount of the developing agent flowing down along the developing chamber inevitably exudes or leaks through the minute gap between the end surfaces of the left and right frame members 90B, 90C of the mask 90 and the electrophotographic film 24. The exuding or leaking excessive developing agent, however, is blown to the lower side of the guide groove means 92 of the developing chamber 98 by the compressed air which is being supplied to the guide groove 92. In this embodiment, since the guide groove 92 is opened at its lower side, it is possible to remove the excessive developing agent without allowing the agent to deposit onto walls of the developing section 66 and in the groove 92 and without causing the agent to be solidified in the guide groove 92.

When a predetermined time has passed after energization of the solenoid 234 of the film pressing mechanism, the motor 128 is stopped to stop the operation of the developer pump 130. The solenoid valve 120, however, is kept opened even after the operation of the pump 130 is stopped. The developer 136 is supplied from the developer tank 126 into the process head 54 by the force of gravity. Therefore, the supply of the developer 136 into the developing chamber 98 is continued even after the stop of the developer pump 130. Therefore, the exposure of the next frame can be conducted with minimum risk of movement which may be caused by the vibration of the developer pump 130. In order to eliminate any unevenness in the tone of the developed image due to movement of the developer in the developing chamber, it is possible to employ a still development in which the development is conducted while the developer is in still state. This can be realized by operating the solenoid valve so as to close the passage of the developer thereby to make the developer still.

When a predetermined opening period has elapsed, the solenoid valve 120 is closed so that the supply of the developer to the developing chamber is ceased. At the same time, the air pump 144 for the pressurized squeezing air is opened thereby allowing the pressurized air to be supplied into the developing chamber 98 through the squeezing air inlet 100 so as to blow off and remove any excessive developer 136 attaching to the surface of the electrophotographic film 24.

The developing agent 136 thus blown off is returned to the developing agent bottle 134 via the developer/-squeeze air outlet 102 through the return conduit 146.

The supply of the pressurized air into the developing chamber 98, i.e., the blowing of air, is conducted gently insofar as the developing chamber 98 still contains sufficient amount of the developing agent, thus preventing degradation of the image which may be caused when a strong blow of air is applied.

In the reader mode of operation, the operator operates a button on the control keyboard 28 so as to continuously feed the electrophotographic film 24 to project images of the successive frames, so that he can see the successive images in a short time. In this mode, the shutter A is closed during movement of the electrophotographic film 24 so as to avoid flicker attributable to after image.

When the copy button on the control keyboard 28 is pressed while an image is projected onto the screen 16, the copy mode is selected so that the copy mirror 52 is moved, whereby the image projected on the screen 16 is copied on a copy paper 30 through the optical system shown in FIG. 4.

As has been described, according to the present invention, there is provided a processing head for use in an electrophotographic apparatus and designed to feed an elongated photosensitive material so as to bring successive frames on the photosensitive material to a developing section to which a developing agent is supplied, thereby to develop images on the successive frames, the processing head comprising: guide groove means having portions disposed upstream and downstream of the developing section as viewed in the direction of feed of the photosensitive material such as to extend in the breadthwise direction of the photosensitive material, the portions having one end at its lower side opened to the outside at positions outside the adjacent breadthwise end of the photosensitive material; pressurized air supply port means disclosed on the opposite side of the photosensitive material to the open ends of the portions of the guide groove means and communicated with the guide groove means at a position within the breadth of the photosensitive material; and pressurized air supply means for supplying the guide groove means with pressurized air through the pressurized air supply port means. It is therefore possible to externally blow off the developing agent which has leaked out of the developing section through the minute gap between the structure of the developing section and the photosensitive material.

What is claimed is:

1. A processing head for use in an electrophotographic apparatus and designed to feed an elongated photosensitive material so as to bring successive frames on said photosensitive material to a developing section to which a developing agent is supplied by developing agent fluid circuit, thereby to develop images on the successive frames, said processing head comprising:

developing mask means having raised mask portions which protrude from said processing head, said raised mask portions for defining and surrounding a frame developing section and aperture, and for contacting said photosensitive material such that a developing agent delivered from a developing agent fluid circuit to said frame developing section and aperture are confined therein;

guide groove means, having raised guide portions which protrude from said processing head, and are sized to substantially surround said developing mask means, for contacting said photosensitive material such that there are defined a groove area substantially surrounding said developing mask means and an exhaust opening which opens to an environment which is different from said frame developing section and said developing agent fluid circuit;

pressurized air supply port means disposed to communicate with said groove area of said guide groove means at a position which is distant from said exhaust opening; and pressurized air supply means for supplying said guide groove means with pressurized air through said pressurized air supply port means such that any of said developing agent which leaks from said developing mask means into said groove area is purged out of said groove area to said environment through said exhaust opening.

2. A processing head for use in electrophotographic apparatus according to claim 1, wherein said raised guide portions have a substantially U-shaped form such that said groove area also has a substantially U-shaped form so as to extend along and substantially surround said developing mask means.

3. A processing head for use in electrophotographic apparatus according to claim 2, wherein said developing mask has a substantially rectangular cross-section.

4. A processing head for use in electrophotographic apparatus according to claim 1, wherein said exhaust opening of aid guide groove means is located at the bottom of said guide groove means and opens downward.

5. A processing head for use in electrophotographic apparatus according to claim 5, wherein said pressurized air supply port means communicates with said groove area at a top of, and in a substantially longitudinal mid portion, of said guide groove means.

6. A processing head for use in electrophotographic apparatus according rot claim 5, wherein said pressurized air supply means includes an air pump for pressurizing air, conduit means for introducing the air pressurized by said air pump to said pressurized air supply port means, and an air flow-rate control means disposed at an intermediate portion of said conduit means and adapted for controlling the flow rate of said pressurized air.

7. A processing head for use in electrophotographic apparatus according to claim 1, wherein said elongated photosensitive material is an electrophotographic film.

8. A processing head for use in electrophotographic apparatus and having a charging/exposure section, developing section, fixing section and drying section arranged in the mentioned order through which a photosensitive material is fed so as to be subjected to processings in the successive sections, said processing head comprising:

developing mask means having raised mask portions which protrude form said processing head, said raised mask portions for defining and surrounding a frame developing section and aperture, and for contacting said photosensitive material such that a developing agent delivered from a developing agent fluid circuit to said frame developing section and aperture are confined therein;

guide groove means, having raised guide portions which protrude from said processing head and are sized to substantially surround said developing mask means, for contacting said photosensitive material such that there are defined a groove area substantially surrounding said developing mask means and an exhaust opening which opens to an environment which is different from said frame developing section and said frame developing agent fluid circuit;

pressurized air supply port means disposed to communicate with said groove area of said guide groove means at a position which is distant from said exhaust opening; and pressurized air supply means for supplying said guide groove means with pressurized air through said pressurized air supply port means such that any of said developing agent which leaks from said developing mask means into said groove area is purged out of said groove area to said environment through said exhaust opening.

9. A processing head for use in electrophotographic apparatus according to claim 8 wherein said raised guide portions have a substantially U-shaped form such that said groove area also has a substantially U-shaped form so as to extend along, and substantially surround, said developing mask means.

10. A processing head for use in electrophotographic apparatus according to claim 9, wherein said developing mask has a substantially rectangular cross-section.

11. A processing head for use in electrophotographic apparatus according to claim 10, wherein said exhaust opening of said guide groove means is located at the bottom of said guide groove means and opens downward.

12. A processing head for use in electrophotographic apparatus according to claim 10, wherein said pressurized air supply port means communicates with said groove area at a top of, and in a substantially longitudinal mid portion, of said guide groove means.

13. A processing head for use in electrophotographic apparatus according to claim 8, wherein said pressurized air supply means includes an air pump for pressurizing air, conduit means for introducing the air pressurized by said air pump to said pressurized air supply port means, and an orifice disposed at an intermediate portion of said conduit means and adapted for measuring the flow rate of the air pressurized by said air pump.

14. A processing head for use in electrophotographic apparatus according to claim 13, wherein said elongated photosensitive material is an electrophotographic film. frame, as explained before.

* * * * *